US011571915B2

(12) United States Patent
Van Heijst et al.

(10) Patent No.: US 11,571,915 B2
(45) Date of Patent: Feb. 7, 2023

(54) INK JET PRINTER FOR PRINTING WITH VARIABLE GLOSS

(71) Applicant: Canon Production Printing Holding B.V., Venlo (NL)

(72) Inventors: Cornelis P. M. Van Heijst, Venlo (NL); Peter J. M. Aarts, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 141 days.

(21) Appl. No.: 17/333,962

(22) Filed: May 28, 2021

(65) Prior Publication Data

US 2021/0283929 A1 Sep. 16, 2021

Related U.S. Application Data

(63) Continuation of application No. PCT/EP2019/081600, filed on Nov. 18, 2019.

(30) Foreign Application Priority Data

Dec. 7, 2018 (EP) ..... 18211028

(51) Int. Cl.
*B41J 11/00* (2006.01)
*B41J 2/21* (2006.01)

(52) U.S. Cl.
CPC ..... *B41J 11/0021* (2021.01); *B41J 2/2107* (2013.01); *B41J 11/00212* (2021.01); *B41J 11/00214* (2021.01); *B41J 11/00218* (2021.01)

(58) Field of Classification Search
CPC ..... B41J 11/0021; B41J 2/2107; B41J 11/00212; B41J 11/00214; B41J 11/00218
See application file for complete search history.

(56) References Cited

U.S. PATENT DOCUMENTS

2012/0281049 A1 11/2012 Kachi
2017/0120626 A1* 5/2017 Allen ..... B41J 11/00218
2018/0222215 A1 8/2018 Schutten

FOREIGN PATENT DOCUMENTS

EP 2 522 519 A2 11/2012
WO WO 2005/039883 A1 5/2005
WO WO 2018/007222 A1 1/2018

OTHER PUBLICATIONS

European Search Report of application 18 21 1028 dated Jun. 19, 2019.
International Search Report (PCT/ISA/210) issued in PCT/EP2019/081600 dated Mar. 6, 2020.
Written Opinion (PCT/ISA/237) issued in PCT/EP2019/081600 dated Mar. 6, 2020.

* cited by examiner

*Primary Examiner* — Bradley W Thies
(74) *Attorney, Agent, or Firm* — Birch, Stewart, Kolasch & Birch, LLP

(57) ABSTRACT

The invention relates to an ink jet printer having a print carriage, a curing unit and a holder arranged to move a recording medium relative to the carriage assembly in a sub-scanning direction, wherein the print carriage is movable in a main scanning direction normal to the sub-scanning direction, and a print head unit arranged on the print carriage for printing a swath of an image onto the recording medium in each scan pass of the print carriage, the print carriage further having a mirror assembly arranged to deflect light from the curing unit onto an exposure area on the printed swath.

15 Claims, 9 Drawing Sheets

INK JET PRINTER FOR PRINTING WITH VARIABLE GLOSS

CROSS REFERENCE TO RELATED APPLICATIONS

This application is a Continuation of PCT International Application No. PCT/EP2019/081600, filed on Nov. 18, 2019, which claims priority under 35 U.S.C. 119(a) to Patent Application No. 18211028.8, filed in the Europe on Dec. 7, 2018, all of which are hereby expressly incorporated by reference into the present application.

The invention relates to an ink jet printer having a print carriage, a curing unit and a holder arranged to move a recording medium relative to the carriage assembly in a sub-scanning direction, wherein the print carriage is movable in a main scanning direction normal to the sub-scanning direction, and a print head unit arranged on the print carriage for printing a swath of an image onto the recording medium in each scan pass of the print carriage, the print carriage further having a mirror assembly arranged to deflect light from the curing unit onto an exposure area on the printed swath.

An ink jet printer of this type has been described in WO 2005039883 A1.

The printer may be operated for example with UV-curing ink, in which case the curing unit will comprise a radiation source that emits ultraviolet radiation. When an ink dot has been printed, it is exposed to the curing radiation, and the liquid ink will solidify.

It is well known in the art that the timing of the cure treatment has an influence on the gloss of the printed image. When each ink dot is cured immediately after it has been printed, the time is not sufficient for the liquid ink to flow and spread on the surface of the recording medium and to form a smooth surface, so that the resulting image will have a relatively matt appearance. On the other hand, when the curing process is delayed, a more glossy ink surface will be obtained. Further, the gloss of the printed image may be influenced by selecting the intensity and/or spectrum of the radiation used.

US 2012281049 A1 describes an ink jet printing method wherein the ink can be cured in two stages. When a low gloss is desired, the ink is subjected to a first cure treatment immediately after it has been printed. In this treatment, which is called "pinning", the ink is not cured entirely, but the viscosity of the ink is increased to such an extent that the ink is immobilized on the recording medium and the spreading tendency of the ink is reduced. Then, in a later second curing step, the ink is cured entirely. When a glossy image or image part is desired, the pinning step is omitted.

In order to print an image with variable gloss, the known printer has a plurality of curing lamps which can be controlled individually so that it can be decided, in principle for each individual pixel, whether it shall be pinned or not. However, such a curing equipment is relatively expensive.

It is an object of the invention to provide an ink jet printer which is capable of printing with variable gloss and requires only a simple and inexpensive curing equipment.

SUMMARY OF THE INVENTION

In order to achieve this object, the mirror assembly comprises first and second mirrors that are offset from one another in the main scanning direction and the exposure area of the second mirror has a smaller dimension in the sub-scanning direction than the exposure area of the first mirror, wherein the curing unit is arranged to in operation selectively provide radiation to one of the mirrors of the mirror assembly.

The radiation emitted by the radiation source and provided to one of the mirrors is used for pinning. Since the exposure area of the second mirror is smaller than that of the first mirror, it does not cover the entire print swath. Thus, if the second mirror is used, the print swath is divided into at least two sub-swathes one of which will be printed with pinning and the other of which will be printed without pinning. Consequently, when the image to be printed includes areas with high gloss and areas with low gloss, the high gloss areas will be printed with a second subset of the ink jet nozzles which are located outside of the exposure area of the second mirror, whereas the matt parts of the image are printed with a first subset of nozzles within the range of the exposure area, so that the ink dots will be pinned. In this way, any desired distribution of glossy and matt image areas can be obtained without having to use a plurality of curing lamps and without having to temporarily shut-off one or more of the curing lamps by means of shutters or the like. Consequently, the curing equipment is simple, robust and inexpensive. The nozzles of the print head form at least a first group and a second group. The nozzles of the first group are aligned with the exposure area of the second mirror in the sub-scanning direction, whereas the nozzles of the second group are offset from the exposure area of the second mirror in the sub-scanning direction. The ratio between the number of nozzles of the first group and the number of nozzles of the second group may be suitably selected. The number of nozzles of the first group may be equal to the number of nozzles of the second group. Alternatively, the number of nozzles of the first group may be different from the number of nozzles of the second group; for example, the number of nozzles of the first group may be larger than the number of nozzles of the second group.

On the other hand, if the image to be printed is desired to be matt on its entire surface, it is possible to use the first mirror, so that the ink dots on the entire width of the print swath will be pinned, and the print productivity is increased because the full width of the ink jet nozzle array can be utilized in each scan pass.

More specific optional features of the invention are indicated in the dependent claims.

The cure carriage may carry one or more additional curing lamps which may be utilized for main curing and/or post curing.

In order to permit bi-directional printing, the print carriage may comprise two print head units which are arranged symmetrically with respect to one another, each unit being used for one of the two opposite scanning directions. In that case the print carriage will also have two mirror assemblies arranged symmetrically on either side of the print head units. Still, the cure carriage needs to have only a single curing lamp for pinning. Depending upon the scanning direction, this curing lamp will be aligned with one of the mirrors on the respective trailing side of the print head units.

In order for the ink dots to be sufficiently immobilized in the time between printing and main curing exposure, it may be advantageous to use gelling inks, which will form a gel as soon as they hit the recording medium and are cooled thereby. In that case, a pinning exposure may be totally dispensed with if a high gloss image is desired. On the other hand, if a non-gelling ink is used, one or two additional curing lamps may be mounted directly on the print carriage in order to provide for a certain ground level of pinning even in those parts of the image where a high gloss is desired. The mirror assembly or mirror assemblies will then be utilized for a more intense pinning exposure in the matt parts of the image.

In an embodiment, the curing unit comprises a lamp, the lamp being mounted on a cure carriage that is movable in the main scanning direction independently of the print carriage. The cure carriage may be moved in reciprocation in the main scanning direction over the recording medium. The entire length of the recording medium—in the main scanning direction—may be irradiated by the curing unit, while using a lamp that has dimensions smaller than the length of the recording medium. The lamp may be suitably selected. Preferably, the lamp is a UV lamp, such as a UV LED or a Hg bulb.

In a further embodiment, the curing lamp is arranged on the cure carriage for emitting curing light towards the print carriage, and wherein the lamp is arranged to selectively provide radiation to one of the mirrors of the mirror assembly by selectively aligning the one of the mirrors with the curing lamp by controlling a relative movement of the cure carriage and the print carriage. The radiation emitted by the curing lamp may be suitably directed towards the mirrors.

In an embodiment, the curing unit comprises a source of radiation and radiation guiding unit, the radiation guiding unit being configured to selectively direct the radiation to one of the mirrors of the mirror assembly. In the embodiment, the source of radiation may be located remote from the print carriage. The source of radiation may located on a fixed position in the ink jet printer and may not move with regard to a frame of the inkjet printer during printing operation. Alternatively, the source of radiation may be located proximate to the print head carriage. For example, the source of radiation may be mounted on the print head carriage. The radiation guiding unit may be configured to be movable with regard to the mirror assembly. By moving the radiation guiding unit, the radiation may be selectively directed to one of the mirrors of the mirror assembly. Optionally, the curing unit may comprise a plurality of radiation guiding units. Each one of the plurality of radiation guiding units may be configured to—in operation—selectively direct radiation to one of the mirrors of the mirrors of the mirror assembly. By selectively switching between the radiation guiding means, radiation may be selectively directed to one of the mirrors of the mirror assembly.

In a further embodiment, the radiation guiding unit comprises an optical fiber. An optical fiber may be a suitable radiation guiding unit. The optical fiber may be positioned moveable with respect to the mirror assembly. The optical fiber may be selectively aligned with one of the mirrors of the mirror assembly. Optionally, the radiation guiding unit may comprise a plurality of optical fibers and the radiation may be selectively guided by one of the optical fibers.

In an embodiment, the radiation guiding unit comprises a rotatable mirror. The mirror may be positioned in the path of radiation emitted by the radiation source. The mirror may be rotated to selectively deflect the radiation towards one of the mirrors of the mirror assembly.

In an embodiment the printer comprises at least one further curing lamp arranged to emit radiation directly onto the holder that supports the recording medium. The further curing lamp may be configured to fully cure the ink applied onto the recording medium. The further curing lamp may cure all ink, irrespective of whether the ink was pinned or not. The further lamp may be positioned downstream in the sub-scanning direction with respect to the print head carriage.

In an embodiment, the print carriage comprises two mirror assemblies disposed symmetrically on opposite sides of the print head unit. This configuration allows pinning ink in both forward and backward scanning movement in the main scanning direction. This is beneficial for the productivity of the inkjet printer.

In an embodiment, the cure carriage comprises only a single curing lamp arranged to emit light towards the print carriage.

In an embodiment, the exposure area of the first mirror has a width in the sub-scanning direction that is equal to the full width of an image swath that is printable with the print head unit in a single scan pass.

When radiation is deflected by a mirror having an exposure area which width in the sub-scanning direction is equal to the full width of an image swath, an entire swath can be pinned using the mirror. This allows making matt prints.

In a further embodiment, the exposure area of the second mirror has a width in the sub-scanning direction that is equal to one half of the width of the exposure area of the first mirror. When radiation is deflected by a mirror having an exposure area which width in the sub-scanning direction is equal to one half of the full width of an image swath, half of the printed swath is pinned, while the other half of the printed swath is not pinned. This allows making prints having matt and gloss areas in an efficient way.

In an embodiment, the mirror assembly comprises a third mirror that is offset from the first and second mirrors in the main scanning direction, the third mirror being configured for deflecting radiation onto a third exposure area and a fourth exposure area, the third mirror comprising a filter for filtering radiation deflected onto the fourth exposure area. The combined width of the third and fourth exposure area may be equal to or smaller than the full width of an image swath that is printable with the print head unit in a single scan pass. Preferably, the combined width of the third and fourth exposure area is smaller than the full width of an image swath that is printable with the print head unit in a single scan pass. In the latter case, part of the printed swath is not pinned, and glossy parts of a print may be printed in a swath simultaneously with parts of the print having a different gloss level. The part of the printed swath corresponding to the third exposure area may be irradiated by the radiation emitted by the curing unit, thereby pinning said part of the printed swath.

The nozzles of the print head may form at least a first group, a second group and a third group. The nozzles of the first group are aligned with the third exposure area of the third mirror in the sub-scanning direction; the nozzles of the second group are aligned with the fourth exposure area of the third mirror, whereas the nozzles of the third group are offset from the exposure area of the third mirror in the sub-scanning direction. The ratio between the number of nozzles of the first group, the number of nozzles of the second group and the number of nozzles of the third group may be suitably selected.

The third mirror may comprise a filter positioned in the radiation path of the curing unit to the fourth exposure area. The filter may filter the radiation passing through the filter, thereby changing the intensity of the radiation and/or changing the spectrum of the radiation. Preferably, the intensity of the radiation is decreased by the filter. Thus, the radiation in the fourth exposure area has intensity lower than the intensity in the third exposure area. Ink that is applied onto the fourth exposure area may receive less radiation and may therefore be pinned to a smaller extent (party pinned) than the ink applied onto the third exposure area. The partly pinned ink may have a gloss level that is higher than the pinned ink, but lower than the ink that was not pinned. Thus, it is possible to make prints that have more than three different gloss levels.

In an aspect of the invention, a method of printing with an ink jet printer according to the invention is provided, the method comprising the steps of:

identifying first image parts in which ink is to be pinned by exposure with light from the curing lamp and second image parts in which the ink is not to be pinned;

using parts of the print head unit that are located within the range of the second exposure area for printing the first image parts, and using parts of the print head unit located outside of the range of the second exposure area for printing the second image parts.

The method is thus suited for being carried out using a printer according to the present invention. The method allows printing matt and gloss parts of a print simultaneously.

In an embodiment, the method comprises a step of aligning the curing lamp with the first mirror and utilizing a full width of the print head unit for printing a swath that does not contain any second image parts.

In an embodiment, a gelling-type radiation-curable ink is used in the print head unit.

BRIEF DESCRIPTION OF THE DRAWINGS

Embodiment examples will now be described in conjunction with the drawings, wherein.

DETAILED DESCRIPTION OF THE INVENTION

Figure 1:
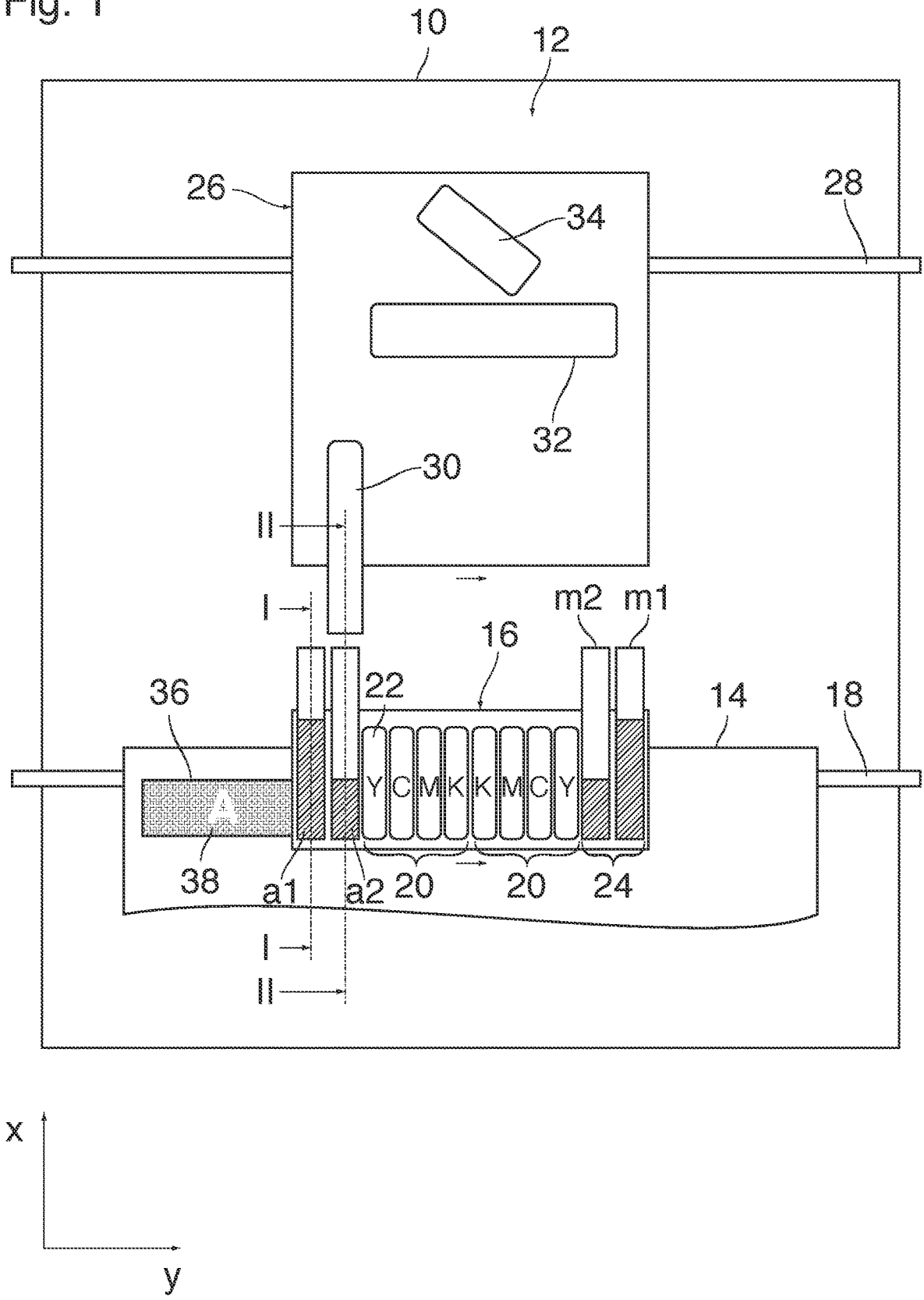
FIG. 1 is a schematic top plan view of an ink jet printer according to the invention.

As is shown in FIG. 1, the ink jet printer comprises a holder 10 and a carriage assembly 12 disposed above the holder. The holder 10, which may be constituted by a conveyor belt, as has been shown in FIGS. 2 and 3, defines a print surface on which a sheet of a recording medium 14 may be advanced relative to the carriage assembly 12 in a sub-scanning direction x (upwards in FIG. 1).

The carriage assembly 12 comprises a print carriage 16 that is driven to move back and forth along a rail 18 in a main scanning direction y.

In the example shown, the print carriage 16 carries two print head units 20 arranged to print a swath of an image onto the recording medium 14. Each print head unit 20 comprises four print heads 22 for printing with inks in the four colors yellow (Y), cyan (C), magenta (M) and black (K). As is well known in the art and not particularly shown in the drawings, each print head 22 has a linear array of ink jet nozzles extending in the sub-scanning direction x, i.e. in transverse direction of the image swath to be printed. The arrangement of the print heads 22 in the two print head units 20 is mirror-symmetric, so that by switching between the two print head units 20 dependent upon the scanning direction of the print carriage 16, it is possible to assure that the inks of different colors will always be deposited in the same sequence.

Two mirror assemblies 24 are disposed symmetrically on both sides of the print head units 20. Each mirror assembly 24 comprises two mirrors m1 and m2 that are arranged side-by-side with an offset in the main scanning direction y.

The carriage assembly 12 further comprises a cure carriage 26 which is driven to move back and forth along a rail 28 in the main scanning direction y. The cure carriage 26 carries three curing lamps 30, 32 and 34. These curing lamps are provided for curing the liquid ink that has been jetted onto the recording medium 14 by means of the print head units 20 by exposing them with ultraviolet light.

The curing lamp 30 is facing the print carriage 16 and is arranged to emit the curing light towards the print carriage 16. The print carriage 16 and the cure carriage 28 can be controlled to move independently of one another. In the condition shown in FIG. 1, both carriages move in the direction from left to right with the same speed in a configuration in which the curing lamp 30 is aligned with the second mirror m2 of the mirror assembly 24 that is disposed on the trailing (left) side of the print head units 20. The second mirror m2 is configured to deflect the light that is emitted by the curing lamp 30 onto an exposure area a2 (hatched in the drawings) on the surface of the recording medium 14.

In case of the second mirror m2, the width of the exposure area a2 in the sub-scanning direction x corresponds to one half of the total print swath that can be printed with the print heads 22 in a single scan pass. Thus, when an ink dot has been printed with a nozzle of one of the print heads 22, which nozzle is located in the lower part of the print head in the drawings, i.e. in the part overlapping with the exposure area a2, then the liquid ink of this dot will be exposed with UV light from the curing lamp 30 immediately after it has been printed. The duration and intensity of this exposure with curing light are selected such that the ink dot is not cured entirely, but is only "pinned", which means that the viscosity of the ink is increased to a level that prevents the ink from spreading on the surface of the recording medium. Then, when the recording medium 14 has been advanced step-wise in the sub-scanning direction x and the ink dot reaches the trajectory of the curing lamp 32, a main curing treatment will be performed by means of the curing lamp 32 which directs UV light directly onto the surface of the recording medium 14 as the cure carriage 26 travels across the recording medium. Then, when the recording medium has been advanced further, a post curing step is performed with the curing lamp 34 which also directs its UV light directly onto the surface of the recording medium 14 on the holder 10.

Figure 2:
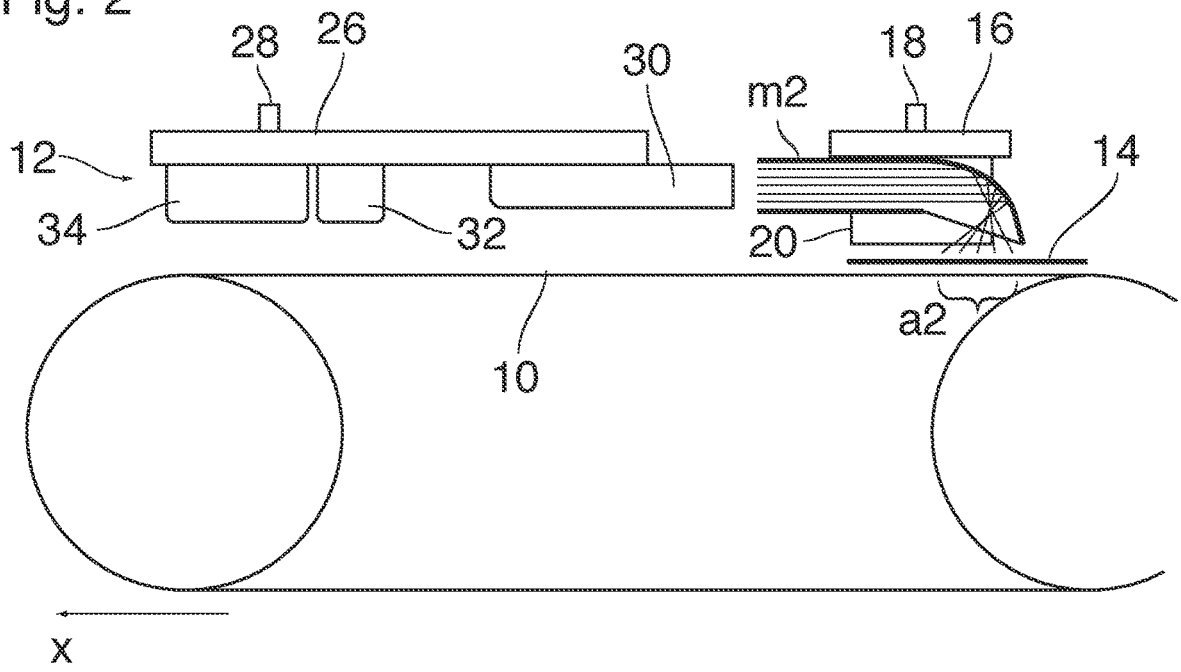
FIGS. 2 and 3 are sectional views taken along the lines II-II and I-I, respectively, in FIG. 1.

The configuration of the second mirror m2 creating the exposing area a2 has been illustrated in FIG. 2.

Figure 3:
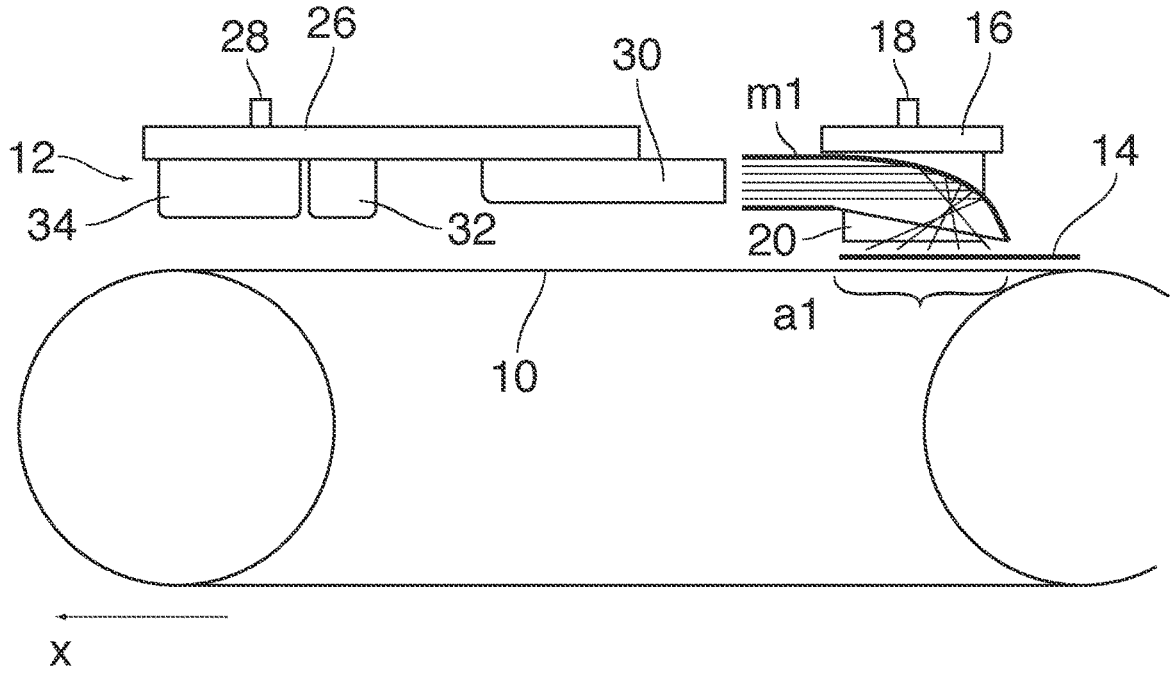

For comparison, FIG. 3 shows the configuration of the first mirror m1 which creates a larger exposure area a1 covering the entire width of the print head units 20.

An example of a print process in which an image to be printed has matt regions as well as high gloss regions distributed over the area of the image will now be described with reference to FIGS. 1 and 4.

As is shown in FIG. 1, a sub-swath 36 of an image has been printed by means of the nozzles in the lower parts of the print heads 20 and the ink has been pinned with light from the curing lamp 30 that has been deflected onto the exposure area a2 of the second mirror m2, so that the printed sub-swath will generally have a matt appearance.

It shall now be assumed that the image is to include also high-gloss items 38 (a character A in this example). In the process described here, the area of the high gloss item 38 has been left blank in the scan pass that is shown in FIG. 1.

Figure 4:
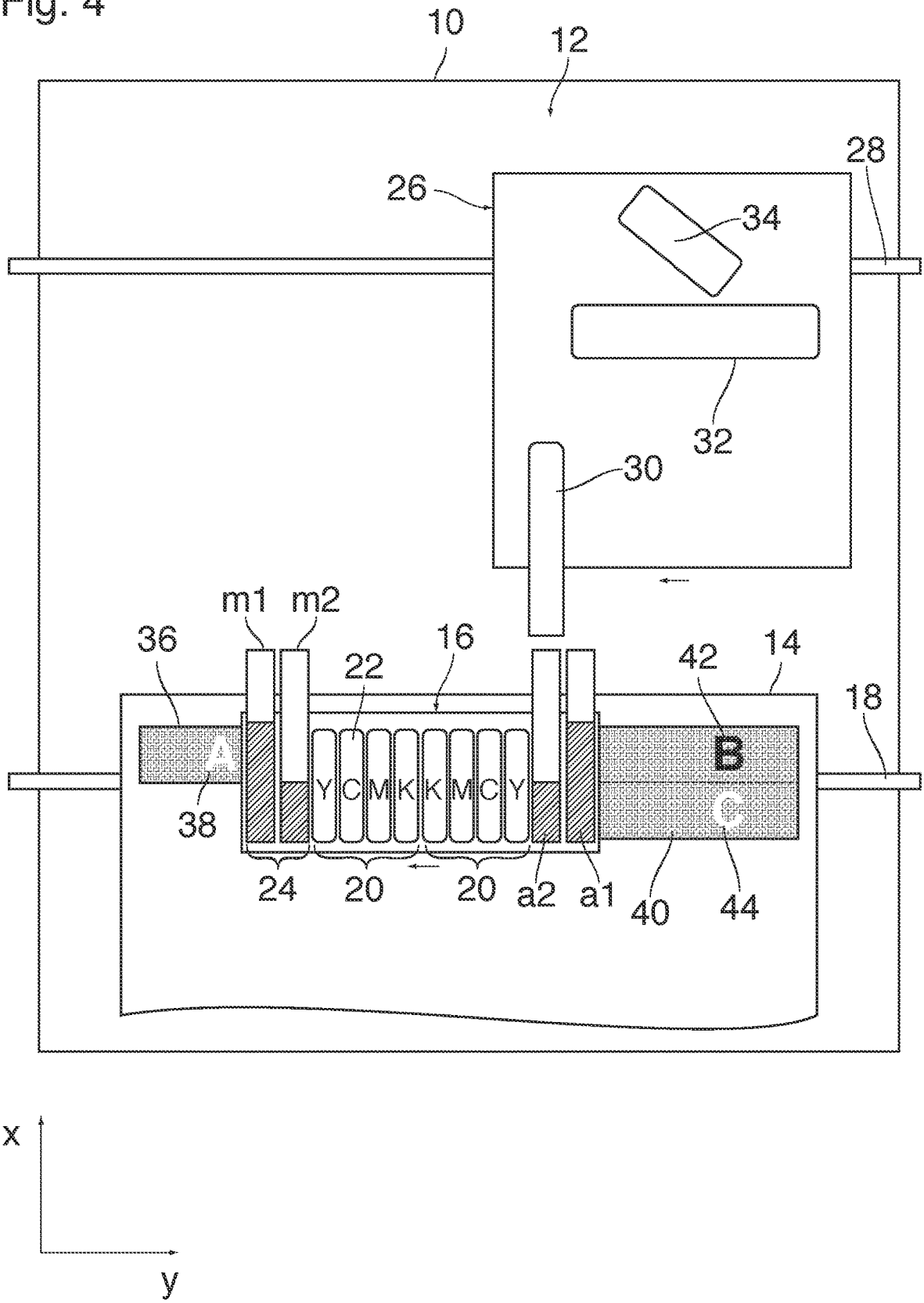
FIG. 4 is a top plan view of the printer during a scan pass in which the scanning direction is opposite to the one shown in FIG. 1.

When this scan pass has been completed, the recording medium 14 is advanced by the width of the sub-swath 36, and another sub-swath 40 is printed, as has been shown in FIG. 4, while the carriages 16 and 26 move from right to left.

The return pass of the cure carriage 26 has been delayed, so that the curing lamp 30 is now aligned with the second mirror m2 on the right side of the print head units 20, which side is now the trailing side. The ink in the sub-swath 40 is accordingly pinned, and the corresponding part of the image will also be matt.

As can further be seen in FIG. 4, the first sub-swath 36 includes another high-gloss item 42 (a character B) which had also been left blank in the first scan pass. However, the blank space of the item 42 has been filled with ink in the return scan pass. Since, in this pass, the high-gloss item 42 is outside of the range of the exposure area a2, the ink constituting the high gloss item 42 is not pinned, so that the liquid ink is allowed to flow and to form a smooth top surface which provides this part of the image with a high gloss. The ink in this part will only be subjected to the curing treatments by means of the curing lamps 32 and 34 when the recording medium 14 is advanced further.

Meanwhile, another high-gloss item 44 (a character C) has been left blank in the sub-swath 40, and this item will be filled with ink in the next scan pass (from left to right) without pinning, because the item 44 will then be located outside of the exposure area a2.

In this way, glossy parts and matt parts of the image can be formed in arbitrary positions.

It is also possible to produce more than two gloss levels by printing a screen of glossy pixels and matt pixels evenly distributed over the image area and by varying the local density ratio of the glossy pixels and the matt pixels in accordance with the desired gloss level.

In general, it is not mandatory that the areas of the high-gloss items are left blank in the print pas in which the swath is printed with pinning. Instead, a matt primer layer may be formed on the print substrate even in those areas where the high-gloss items are to be formed. Then, in the scan pass that is performed without pinning, ink will be superposed on the matt primer layer in order to form a glossy surface layer.

Figure 5:
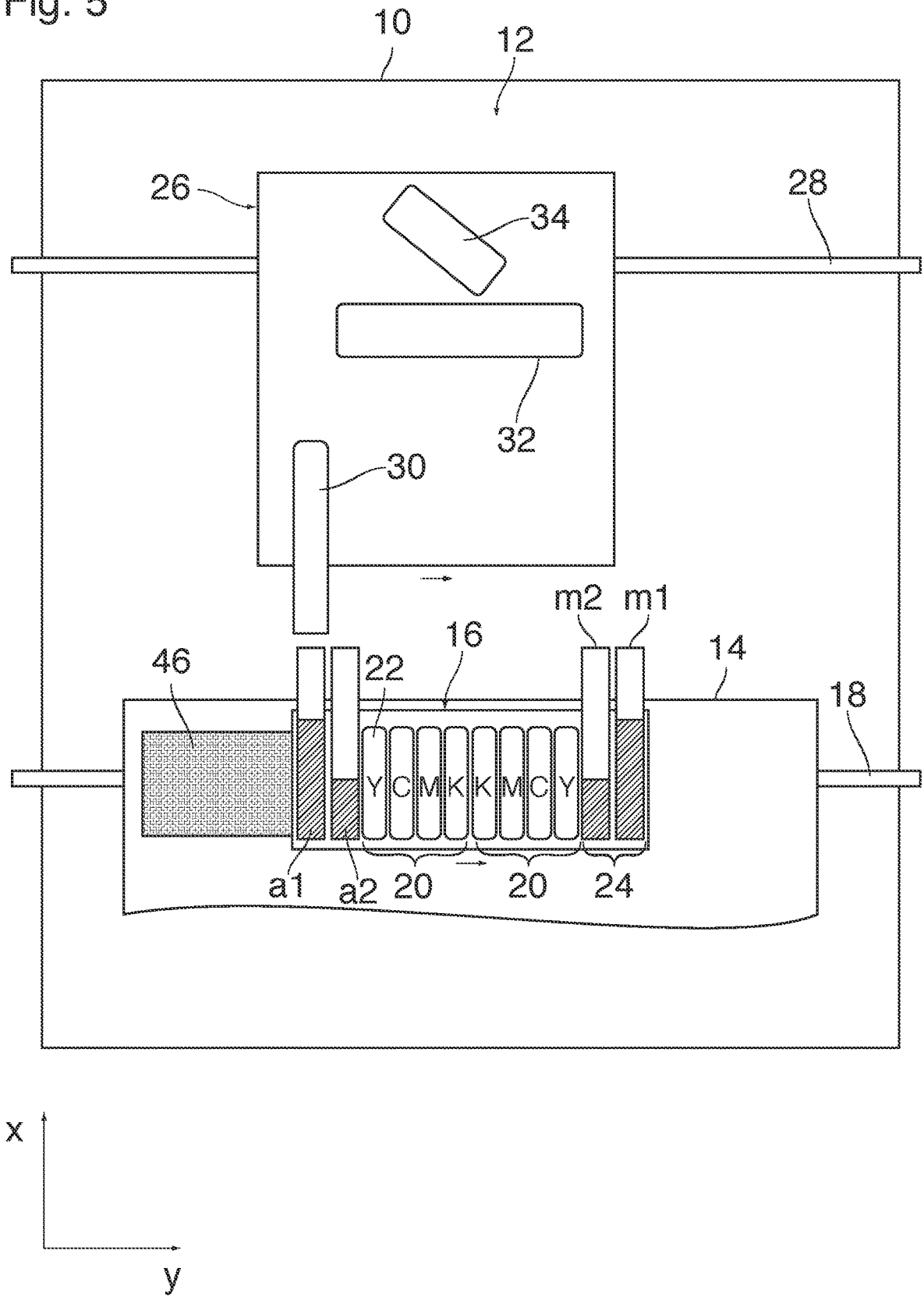
FIGS. 5 and 6 are top plan views of the printer in a print mode for all-matt printing.
Figure 6:
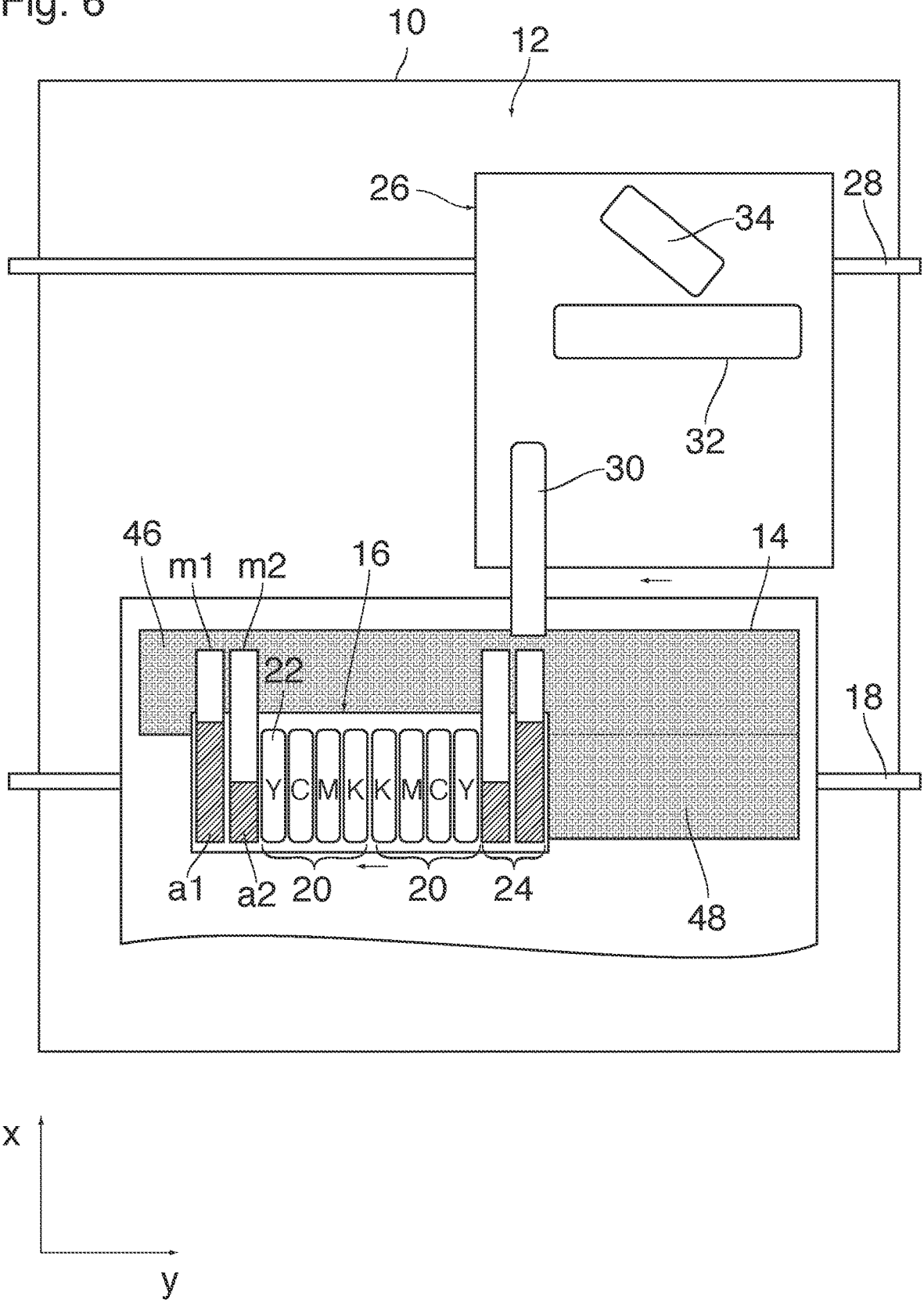

A high production print mode for printing all-matt images will now described in conjunction with FIGS. 5 and 6.

In FIG. 5, the print carriage 16 travels from left to right and prints a swath 46 which has twice the width of the sub-swathes 36 and 40 mentioned above and which covers the entire width of the print head units 20. The curing lamp 30 is aligned with the first mirror m1 of the mirror assembly 24 on the trailing side of the print carriage, so that the entire swath 46 is pinned.

When the print pass has been completed, the recording medium 14 is advanced by the width of the swath 46, and an adjacent swath 48 is printed in the return pass, as has been shown in FIG. 6. In this return pass, the curing lamp 30 is aligned with the first mirror m1 of the mirror assembly 24 at the right end of the print carriage 16, so that the ink will also be pinned. Since, in this mode, the width of the advance steps of the recording medium 14 is twice as large as in the mode shown in FIGS. 1 and 4, the productivity is doubled.

It will be understood that this high production mode can also be employed when printing all-glossy images which contain no matt areas. In that case, the curing lamp 30 will simply be switched off or the movement of the cure carriage 26 will be controlled such that the curing lamp 30 is entirely offset from the mirror assemblies 24.

In printing applications in which most of the image area is matt and high gloss items occur only sporadically, it is possible to enhance the productivity by employing a mixed mode in which most of the image is printed with full width swathes such as the swathes 46 and 48, and sub-swathes such as 36 and 40 are used only in those parts of the image where high-gloss items occur.

Such a mixed mode can also be employed in cases where the image is generally glossy but includes sporadic low-gloss items.

Figure 7:
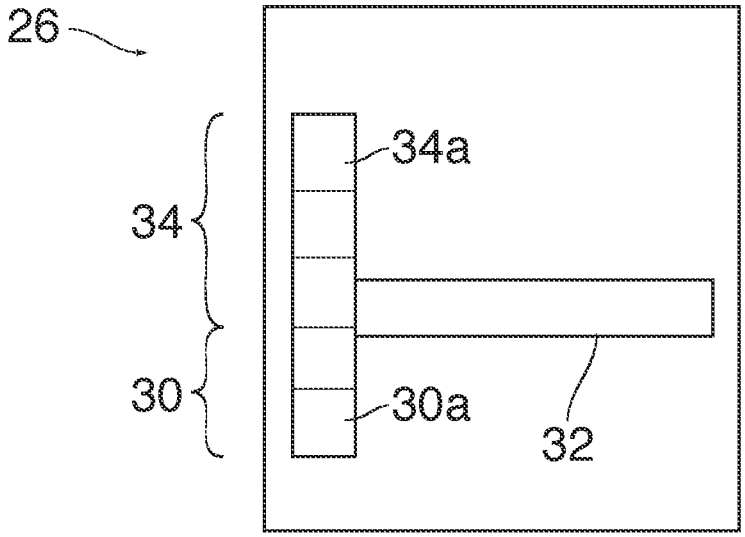
FIG. 7 shows a cure carriage of a printer according to a modified embodiment.

FIG. 7 shows a modified example of the cure carriage 26 wherein the cure lamps 30 and 34 are constituted a common lamp unit which has a plurality of individually controllable sections 30*a* and 34*a*. The sections 30*a* are arranged and configured for use as pinning lamps, whereas the sections 34*a* are used only for post curing.

Figure 8:
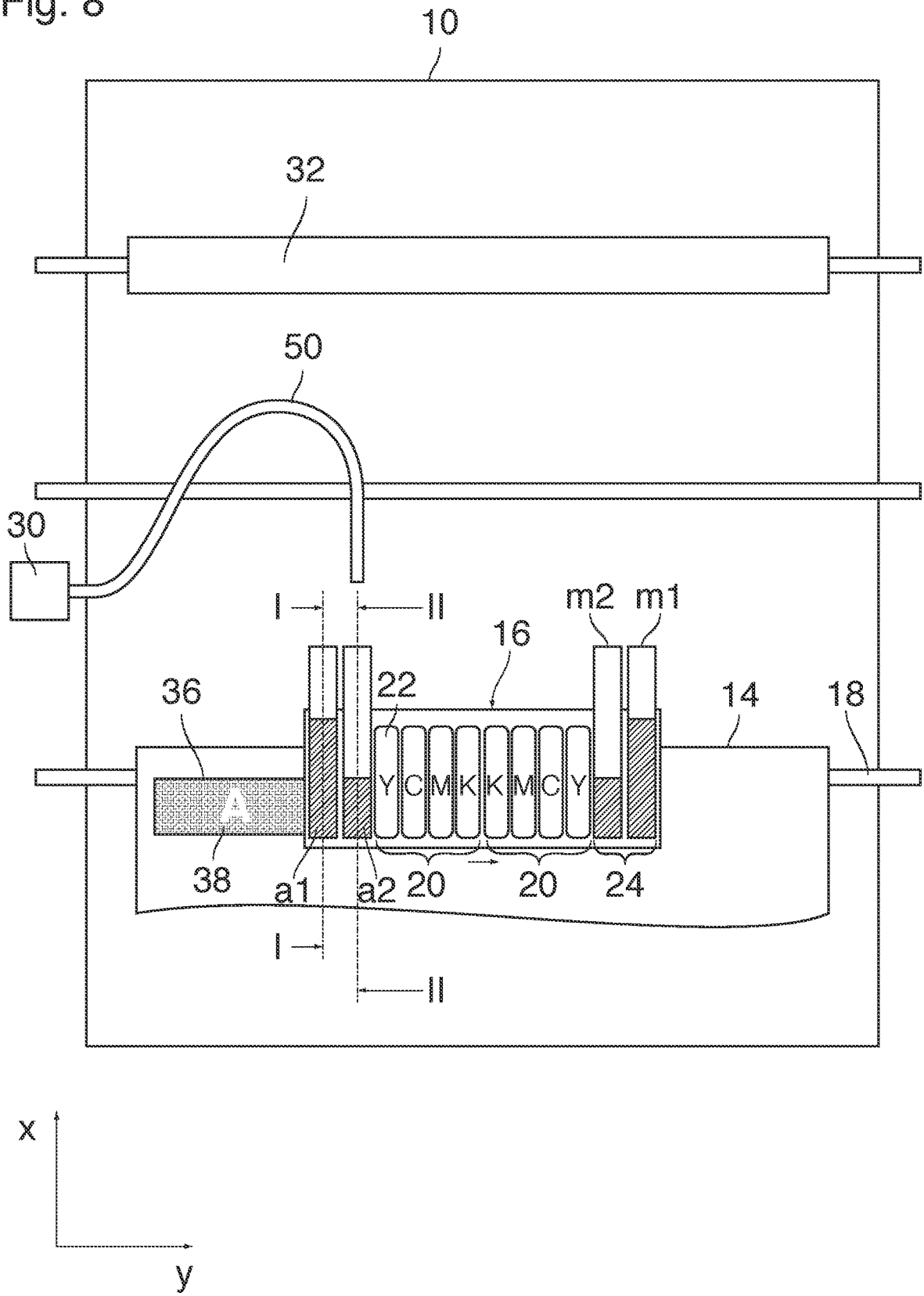
FIG. 8 is a top plan view of a second example of a printer according to the present invention

FIG. 8 shows a second example of a printer according to the present invention. The printer has a print carriage 16, as was previously shown in FIG. 1. The printer shown in FIG. 8 further comprises a curing lamp 30. The curing lamp 30 is mounted on the printer frame (not shown). The curing lamp 30 has a fixed position with regard to the printer frame. The curing lamp 30 is connected to an optical fiber 50. The curing lamp 30 is configured to emit radiation. The optical fiber 50—in operation—transports this radiation.

An end portion of the optical fiber 50 is moveable along a guiding rail. By moving the end portion of the optical fiber 50, the optical fiber can be selectively positioned with regard to the mirrors m1, m2 mounted on the print carriage 16. In FIG. 8, the end portion of the optical fiber 50 is aligned with second mirror m2 and hence, radiation emitted by the curing lamp 30 is directed to second mirror m2. Alternatively, the end portion of the optical fiber 50 may be aligned with the first mirror m1 or may not be aligned with any of the mirrors.

The printer further comprises a page-wide curing lamp 32.

Figure 9:
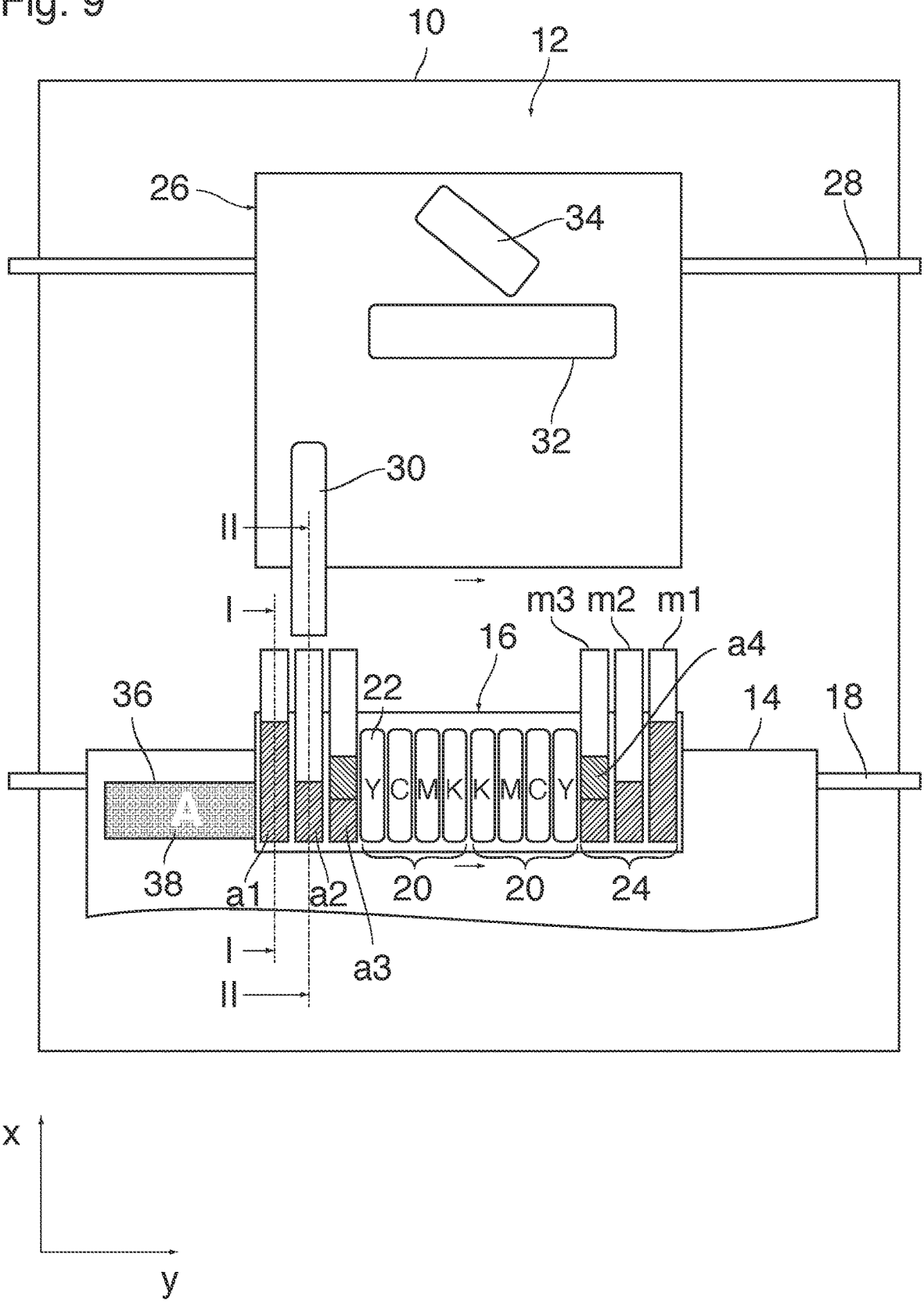
FIG. 9 is a top plan view of a third example of a printer according to the present invention

FIG. 9 shows a top plan view of a third example of a printer according to the present invention. The printer according to the shown in FIG. 9 comprises a print carriage 16. Two mirror assemblies 24 are disposed symmetrically on both sides of the print head units 20. Each mirror assembly 24 comprises three mirrors m1, m2 and m3 that are arranged side-by-side with an offset in the main scanning direction y. The third mirror m3 is configured to deflect radiation that is emitted by curing lamp 30 onto exposure areas a3 and a4 on the surface of the recording medium.

Figure 10:
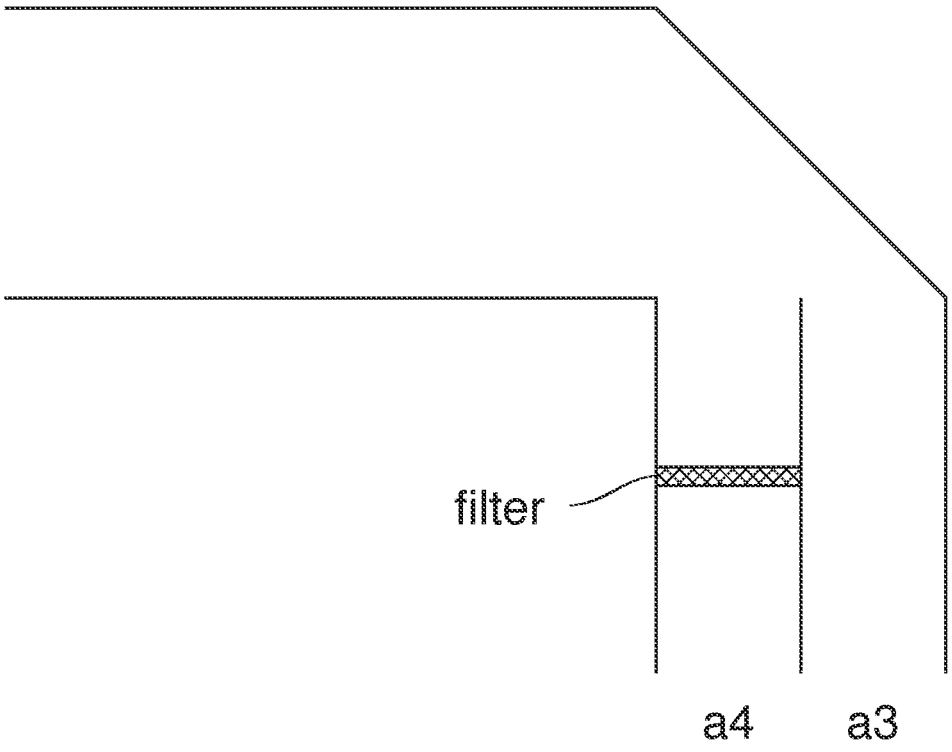
FIG. 10 is a schematic representation of a mirror in accordance with the present invention

A schematic representation of mirror m3 is shown in FIG. 10. The mirror m3 comprises an inner wall to separate the radiation deflected onto exposure area a3 from radiation that is deflected onto exposure area a4. The radiation deflected onto exposure area a4 passes through a filter (filter) that is provided in the interior of the mirror m3, in between an outer wall of the mirror m3 and the wall separating the radiation deflected onto exposure area a3 from radiation that is deflected onto exposure area a4. The filter may absorb part of the radiation passing through the filter, thereby altering the intensity of the radiation.

The ink applied onto exposure area a4 therefore receives radiation having a lower intensity than the intensity received by ink applied onto exposure area a3. The ink applied onto exposure area a3 may therefore be pinned to a higher extent than the ink applied onto exposure area a4. The ink applied outside exposure areas a3 and a4 may not be pinned at all. Using mirror a3, a printed image can be formed, wherein the printed image has three different gloss levels.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed. Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention claimed is:

1. An ink jet printer having a print carriage that is movable in a main scanning direction, the print head carriage carrying at least one printing unit for printing a swath of an image onto the recording medium;

a holder arranged to move a recording medium relative to the print carriage in a sub-scanning direction normal to the main scanning direction, and a curing unit configured to in operation emit radiation, the print carriage further having a mirror assembly arranged to deflect radiation from the curing unit onto an exposure area on the printed swath, characterized in that the mirror assembly comprises first and second mirrors that are offset from one another in the main scanning direction and the exposure area of the second mirror has a smaller dimension in the sub-scanning direction than the exposure area of the first mirror, wherein the curing unit is arranged to in operation selectively provide radiation to one of the mirrors of the mirror assembly.

2. The ink jet printer according to claim 1, wherein the curing unit comprises a lamp, the lamp being mounted on a cure carriage that is movable in the main scanning direction independently of the print carriage.

3. The ink jet printer according to claim 2, wherein the curing lamp is arranged on the cure carriage for emitting curing light towards the print carriage, and wherein the lamp is arranged to selectively provide radiation to one of the mirrors of the mirror assembly by selectively aligning the one of the mirrors with the curing lamp by controlling a relative movement of the cure carriage and the print carriage.

4. The ink jet printer according to claim 1, wherein the curing unit comprises a source of radiation and radiation guiding unit, the radiation guiding unit being configured to selectively direct the radiation to one of the mirrors of the mirror assembly.

5. The ink jet printer according to claim 4, wherein the radiation guiding unit comprises an optical fiber.

6. The ink jet printer according to claim 4, wherein the radiation guiding unit comprises a rotatable mirror.

7. The ink jet printer according to claim 1, wherein the printer comprises at least one further curing lamp arranged to emit radiation directly onto the holder that supports the recording medium.

8. The ink jet printer according to claim 1, wherein the print carriage comprises two mirror assemblies disposed symmetrically on opposite sides of the print head unit.

9. The ink jet printer according to claim 1, wherein the cure carriage comprises only a single curing lamp arranged to emit light towards the print carriage.

10. The ink jet printer according to claim 1, wherein the exposure area of the first mirror has a width in the sub-scanning direction that is equal to the full width of an image swath that is printable with the print head unit in a single scan pass.

11. The ink jet printer according to claim 10, wherein the exposure area of the second mirror has a width in the sub-scanning direction that is equal to one half of the width of the exposure area of the first mirror.

12. The ink jet printer according to claim 1, wherein the mirror assembly comprises a third mirror that is offset from the first and second mirrors, in the main scanning direction, the third mirror being configured for deflecting radiation onto a third exposure area and a fourth exposure area, the third mirror comprising a filter for filtering radiation deflected onto the fourth exposure area.

13. A method of printing with an ink jet printer according to claim 1, the method comprising the steps of:

identifying first image parts in which ink is to be pinned by exposure with light from the curing lamp and second image parts in which the ink is not to be pinned;

using parts of the print head unit that are located within the range of the second exposure area for printing the first image parts, and using parts of the print head unit located outside of the range of the second exposure area for printing the second image parts.

14. The method according to claim 13, comprising a step of aligning the curing lamp with the first mirror and utilizing a full width of the print head unit for printing a swath that does not contain any second image parts.

15. The method according to claim 13, wherein a gelling-type radiation-curable ink is used in the print head unit.

* * * * *